US006659710B2

(12) United States Patent
Gamberini

(10) Patent No.: US 6,659,710 B2
(45) Date of Patent: Dec. 9, 2003

(54) STATION FOR FORMING STACKS OF LAYERS OF ARTICLES

(75) Inventor: Gianluigi Gamberini, Bologna (IT)

(73) Assignee: Techmatic S.r.l. (IT)

( * ) Notice: Subject to any disclaimer, the term of this patent is extended or adjusted under 35 U.S.C. 154(b) by 101 days.

(21) Appl. No.: 10/102,107

(22) Filed: Mar. 19, 2002

(65) Prior Publication Data

US 2002/0136628 A1 Sep. 26, 2002

(30) Foreign Application Priority Data

Mar. 21, 2001 (CH) ..... 0526/01

(51) Int. Cl.[7] ..... B65G 57/00

(52) U.S. Cl. ..... 414/794.7; 53/153; 198/418.4; 414/794.4

(58) Field of Search ..... 414/788.1, 794.4, 414/794.7, 790.3; 198/458, 418.4, 418.3; 53/153

(56) References Cited

U.S. PATENT DOCUMENTS 3,455,085 A 7/1969 McIntyre
4,166,525 A 9/1979 Bruno
4,450,949 A 5/1984 Buschor et al.

*Primary Examiner*—Donald W. Underwood
(74) *Attorney, Agent, or Firm*—William J. Sapone; Coleman Sudol Sapone, P.C.

(57) ABSTRACT

In a station for forming stacks of layers of articles, a horizontal supporting surface has a window for allowing a layer to pass freely therethrough. First pushing bars drive the layers along the support surface. A stationary descending ramp starts from the initial part of the window and extends downstream. A horizontal lower surface is situated after the ramp and under a horizontal upper surface, and forms a part of the support surface situated downstream of the window. An additional conveyor is associated to the window to restore cyclically a continuity in the support surface in the region of the window for the odd layers, and consequently to direct each odd layer toward the upper surface, and to allow the even layers to pass cyclically through the window. The even layers are consequently directed, due to gravity, onto the ramp. Second pushing bars move each even layer to the ramp and convey the even layer to the lower surface. Third pushing bars move then each even layer on the lower surface, situated below. The even layer moves with the same speed as the corresponding odd layer, pulled by one of the first pushing bars on the upper surface.

16 Claims, 5 Drawing Sheets

STATION FOR FORMING STACKS OF LAYERS OF ARTICLES

FIELD OF THE INVENTION

The present invention relates to a station for forming stacks of layers of articles in a machine for packaging rolled paper products.

DESCRIPTION OF THE PRIOR ART

There are machines for packaging stacks of articles, in particular substantially cylindrical articles, into relative wrappings obtained from a sheet of heat-weldable material.

In the following, the reference will be made paper rolls, for sake of simplicity.

The above-mentioned machines include:

- a grouping station, in which layers of rolls are defined, with each layer being formed by rolls arranged one beside another in an ordered way;
- a station, in which a stack is formed by one or two layers arranged one over the other, and
- a wrapping station, in which the stack is wrapped with a heat-weldable material to obtain the above mentioned wrapping.

The present invention relates to the station, in which the stack is formed.

There are already known stations for forming stacks of layers of cylindrical articles.

In particular, each of the documents U.S. Pat. No. 3,455,085, IT 1.225.033 describes a station including:

- a surface for supporting layers of cylindrical articles coming from the grouping station, situated upstream, with the final part of the supporting surface turned toward the wrapping station and driven into a motion so as to form a kind of pendulum, so as to define as many positions as the layers to be obtained;
- a plurality of receiving planes, which are situated one over another and whose number corresponds to the number of layers, with each of the receiving planes having one end turned toward the grouping station and being adjacent and situated at the same level as the moving end of the above mentioned pendulum in a corresponding position of the latter;
- first means for moving the pendulum to define one of the positions;
- second means for moving said layers along the supporting surface, acting in time relation with said first means;
- third means for each of said receiving planes, equipped with pushing elements, which move forward synchronously and aligned vertically above the receiving planes.

The stack is formed on the lower receiving plane. Since the layers are moved with the same speed, there is no reciprocal rubbing between different layers during the stack forming.

The above-mentioned first means are connected to the pendulum and are, therefore, also driven into oscillation. Also motor means are likewise fastened to the pendulum to impose the oscillation with respect to the hinge with the supporting surface.

It is to be pointed out that the inertia of the pendulum and the devices connected thereto affect the time required for the passage of the pendulum from one position to the subsequent one.

Moreover, during its oscillation, the pendulum carries rolls, which may detach therefrom after a given speed has been reached.

This reduces the production rate of the stack forming station.

SUMMARY OF THE INVENTION

The object of the present invention is to propose a station for forming a stack of layers of articles that solves the above-mentioned problems, in particular that does not have parts moving with an oscillating alternate motion, which connect the plane supporting the layers of articles arriving from the grouping station, with the working planes for receiving the layers.

Another object of the present invention is to propose a station, in which the articles are driven into a continuous motion, so as to increase the production rate with respect to the known stations fulfilling the same function.

A further object of the present invention is to propose a station for forming a stack of layers of articles which does not jeopardize the operation of the grouping station, situated upstream, nor of the wrapping station, situated downstream, and which consists of combination of devices and elements easy to manufacture and of safe functionality.

The above-mentioned objects are obtained by a station for forming stacks of layers of articles, situated downstream of a station for feeding the layers, said forming station including:

- a horizontal supporting surface;
- a first surface, situated after said horizontal support surface and distanced therefrom, so as to define a window, with the dimension of said window allowing one layer of said articles layers to pass freely therethrough;
- first moving means for moving the layers along said support surface and first surface;
- a stationary descending ramp, which begins from the initial part of said window and extends downwards;
- a second horizontal surface, situated after the downstream end of said ramp and below said first working plane;
- an additional conveyor associated to at least said window and aimed at moving, cooperating with said first moving means, odd layers from said support surface to said first surface while allowing even layers coming from said support surface to pass through the window, thus directing the even layers, due to gravity, onto said stationary descending ramp;
- second moving means for moving each even layer to said ramp and conveying said even layer to said second surface; third means for moving each even layer onto said second surface, situated below, with said even layer moving with the same speed as the corresponding odd layer, conveyed thereover by said first moving means on said first working plane.

BRIEF DESCRIPTION OF THE DRAWINGS

The characteristic features of the present invention will be pointed out in the following description of a preferred, but not unique embodiment, with reference to the enclosed drawings, in which.

DISCLOSURE OF THE PREFERRED EMBODIMENTS

Figure 1A:
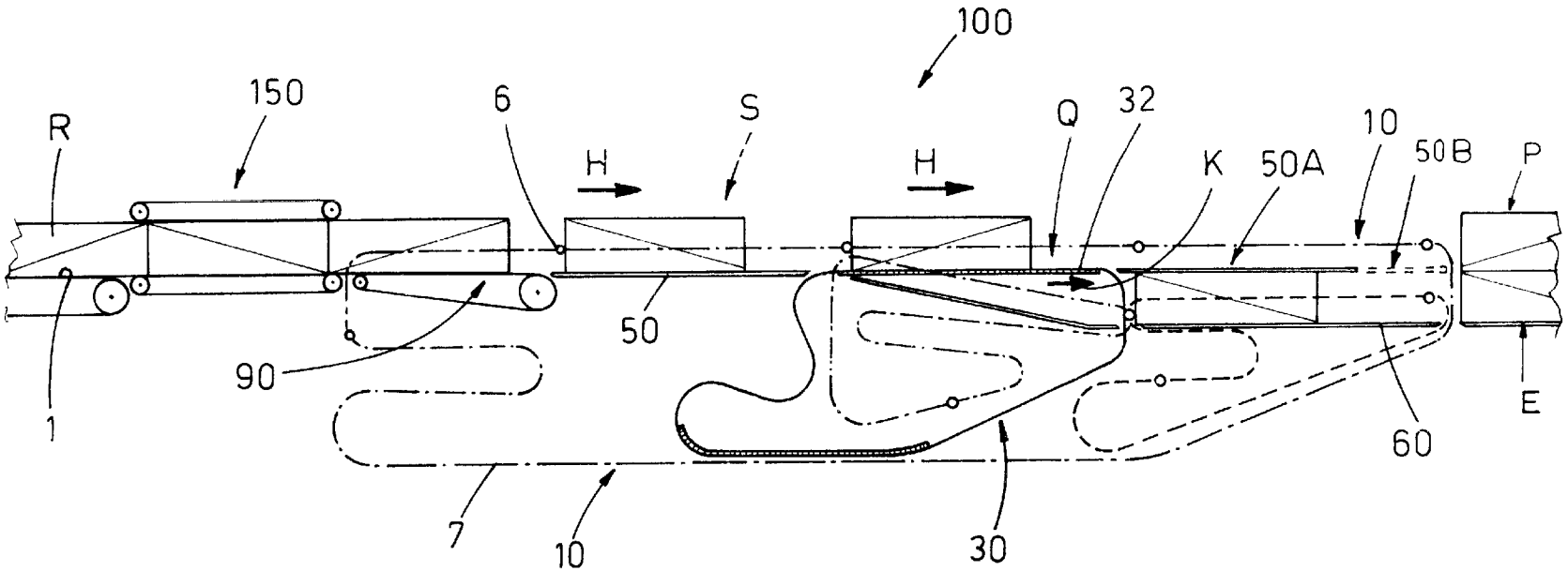
FIG. 1A is a schematic side view of the proposed station for forming a stack of layers of articles.
Figure 1B:
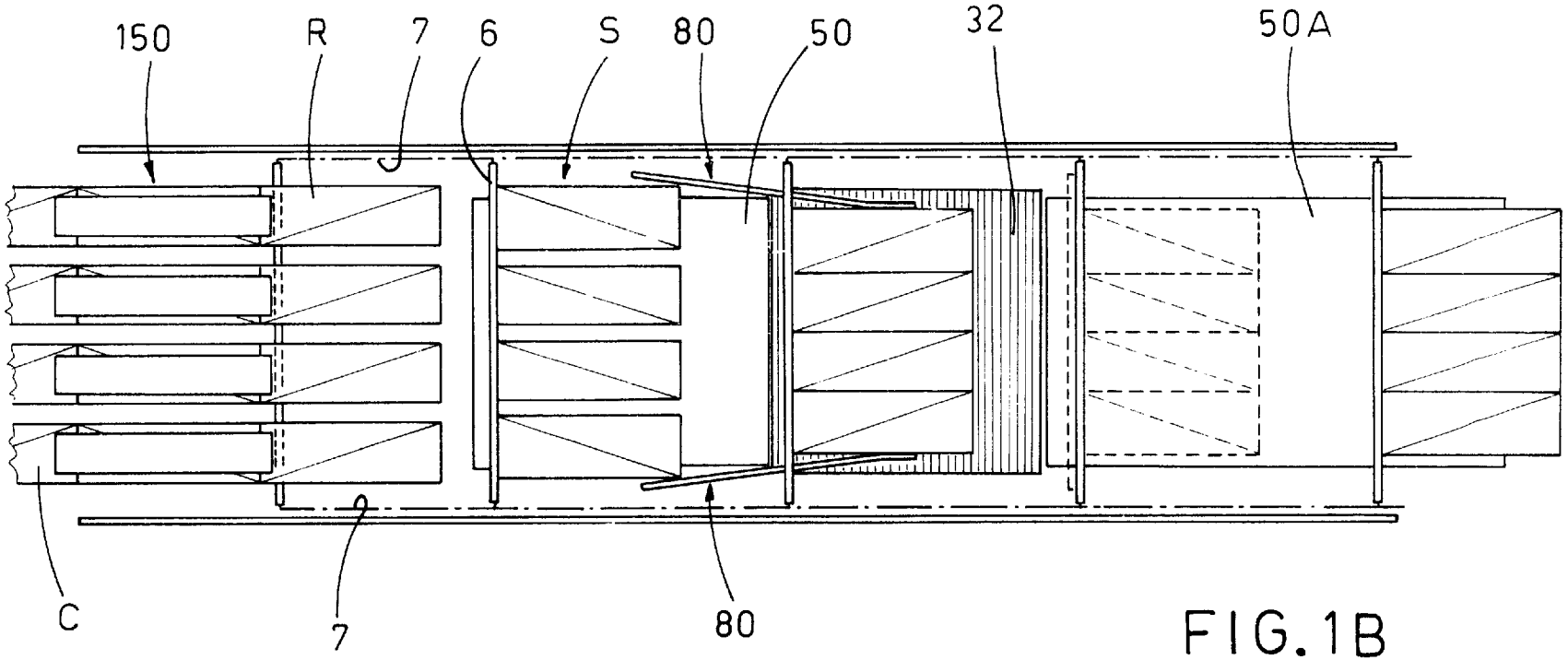
FIG. 1B is a top view of what is shown in FIG. 1A.
Figure 2:
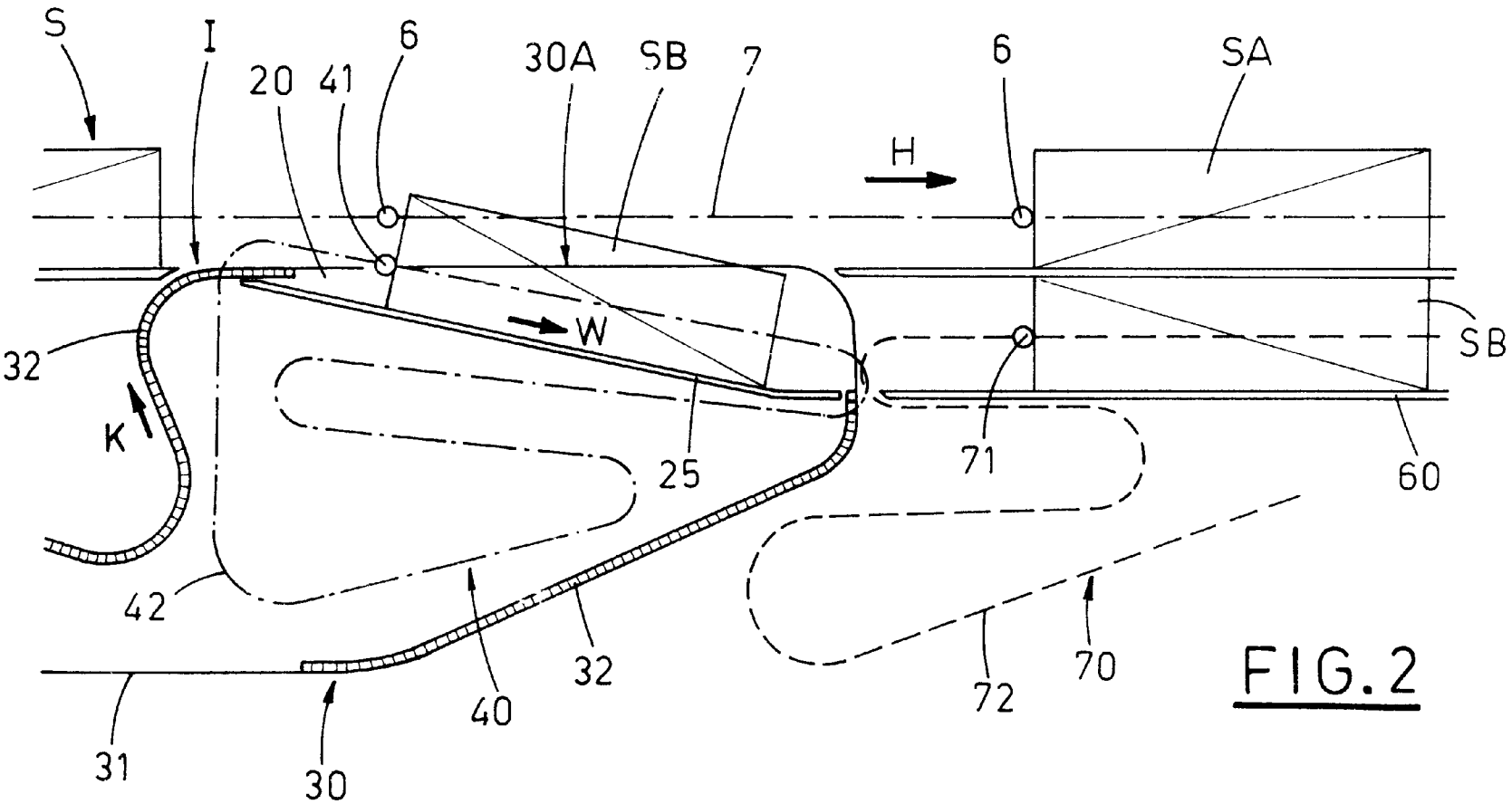
FIG. 2 is an enlarged view of a portion of the proposed station, to highlight a characteristic functional technical aspect.

With reference to the FIGS. 1A, 1B, 2, the letter C indicates the channels guiding the stacks of cylindrical articles, e.g. rolls of paper R.

The channels C are connected to a conveying line 1, which is situated below and conveys the articles (direction H) toward a grouping station 150.

In the shown example, the rolls axes are parallel to the direction H, however they can be arranged also vertically.

The grouping, or feeding station releases intermittently, in a way known to those skilled in the art, layers S of rolls in a downwards direction, more precisely toward the station 100, subject of the present invention.

Each layer S is formed by a selected number of rolls arranged one beside another, horizontal or vertical.

A horizontal support surface 50 extends downwards from the grouping station up to a wrapping station (not shown).

First moving means 10, connected to the horizontal support surface 50, include e.g. first spaced out bars 6, transversal to the direction H, which are carried by two first endless chains 7, extending along vertical planes, arranged on both longitudinal sides of the surface 50.

A window 20 is made in the supporting surface 50 and its dimension is such to allow the maximum dimension of the layer S to pass therethrough.

The maximum dimension of the layer S is defined by a number of rolls equal to the number of channels C.

Downstream of the window 20, the support surface 50 forms a first horizontal upper surface 50A.

A stationary descending ramp 25, adjustable in relation to the rolls size, is situated under the window and extends downwards from the initial part of the window up to a second horizontal lower surface 60, situated below the upper surface 50A.

The upper surface 50A is separated from the lower surface 60 by a section, which is not smaller than the layer height, adjustable in relation to the size.

The window 20 features, connected thereto, the upper run 30A of an additional conveyor 30, formed by a pair of endless chains 31 extending in vertical ideal planes situated beside the longitudinal sides of the window.

At least one part of the chains is connected to the end of flexible elements (e.g. small transversal bars or rolls) which form a flexible shutter 32, or a moving platform 32, whose extension in the direction K of the additional conveyor is substantially equal to the longitudinal dimension of the window.

In the example shown in FIGS. 1A, 2, there are two shutters 32.

It is to be pointed out that, when it is in the region of the window 20, the shutter 32 is arranged horizontally at the same level as the support surface 50: in this situation, the continuity of the support surface 50 is restored.

The speed of the additional conveyor 30, and consequently of the shutter 32 is equal to the speed of the bars 6, for the purpose which will be explained later on.

Second moving means 40 are connected to the stationary descendent ramp 25 and are formed by e.g. second spaced out transversal bars 41 carried by two second endless chains 42 extending along vertical planes situated beside the longitudinal sides of the ramp.

The second bars involve the initial part of the ramp, and consequently of the window, and they run parallel to the ramp up to the final part thereof, as shown in FIGS. 1A, 2.

Third moving means 70 are connected to the lower surface 60 and are formed by e.g. third spaced out transversal bars 71 carried by two third endless chains 72 extending along vertical planes situated beside the longitudinal sides of the lower surface.

Operation of the proposed station results immediately understood from the above description.

Each layer S comes out of the grouping or feeding station 150 and is placed onto a belt 90 to be moved away from the station 150: this allows a first bar 6 of the first moving means 10 to act on the rear part of the layer S to pull it on the support surface 50.

Afterwards, the rolls of each layer S are compacted crosswise according to a technique known to those skilled in the art, e.g. by means 80 indicated in a general way in FIG. 1B.

The reciprocal positioning of the first bars 6 of the first moving means 10 and the shutters 32 is such that, when one shutter 32 covers progressively, from one upstream side toward the downstream side, the window 20 (working position Q in FIG. 1A), a layer S, indicated as odd layer SA in FIG. 1A, is placed on the shutter and the first moving bar 6 acts on its rear part.

Thus, the combined action of the shutter 32, which moves in the direction K and of the first bar 6, which moves in the direction H, concordant with the direction K, transfers the odd layer SA to the initial part of the upper surface 50A.

The speed of the shutter is equal to the speed of the first bars 6 in order to avoid relative rubbing between the shutter 32 and the layer SA, or the disengaging of the first bar 6 from the layer SA.

The length of the portion of the chains 31 between two subsequent shutters 32 is such that no shutter covers the window 20 when an even layer, indicated with SB, subsequent to the previous odd layer SA, reaches the window.

Consequently, the even layer SB is directed, due to gravity, to the descendent ramp 25, where a second bar 41 of the second moving means 41 acts on it (direction W, FIG. 2).

The second bar 41 transfers the even layer SB to the lower surface 60, where a third bar 71 of the third moving means 70 acts on it.

The third bar 71 is situated under a first bar 6 of the first moving means 10, aligned therewith on the same vertical plane, thus it is staggered with respect to the arrival of the bar 41 (of the second moving means 40).

Consequently, the even layer SB stops (on the lower surface 60) and then starts again in step relation with the odd layer SA situated above on the upper surface 50A.

The first bars 6 and second bars 71, moving with the same speed, pull the respective layers SA, SB, respectively odd and even, on the first and second surfaces 50A, 60.

Obviously, in order to form a stack of two layers, it is necessary to put the layers one over another.

For this purpose, the lower surface 60 can e.g. extend beyond the end of the final part of the upper surface 50A by a section longer than the layers longitudinal extension. Consequently, the odd layer SA is put over the even layer SB without reciprocal rubbing of one layer with respect to the other, since they move with the same speed.

Thus, a stack P is formed of two layers SB, SA, respectively even and odd.

Consequently, each odd layer SA is directed, with the help of the shutter 32, toward the upper surface 50A; the even layer SB, preceding the odd layer SA, has been conveyed, due to the presence of the window 20, first to the descendent ramp 25 and then to the lower surface 60, where the even layer SB is below said odd layer SB situated on the upper surface 50A.

The above-described embodiment allows formation of stacks of two layers.

According to the shown example, the continuity of the upper surface is restored cyclically by a shutter; it is understood that other means fulfilling the same function can be used, e.g. an endless belt moving horizontally, with one side parallel to the longitudinal extension of the window.

According to the second embodiment (FIGS. 3A, 3B), the upper surface, indicated with 500A, is moved and constitutes a shutter 132 of the additional conveyor 30 (in the shown example, there are four equidistant shutters 132A, 132B, 132C, 132D), whose upper run 30A is long enough to extend horizontally above the lower surface 60 (from which there is a distance bigger than the layer height, adjustable in relation to the size), and to pass horizontally through the final part 100*a* of the proposed station 100, where the two layers SA, SB, odd and even, are kept motionless and arranged one above another, e.g. placed on an elevator E.

Figure 3A:
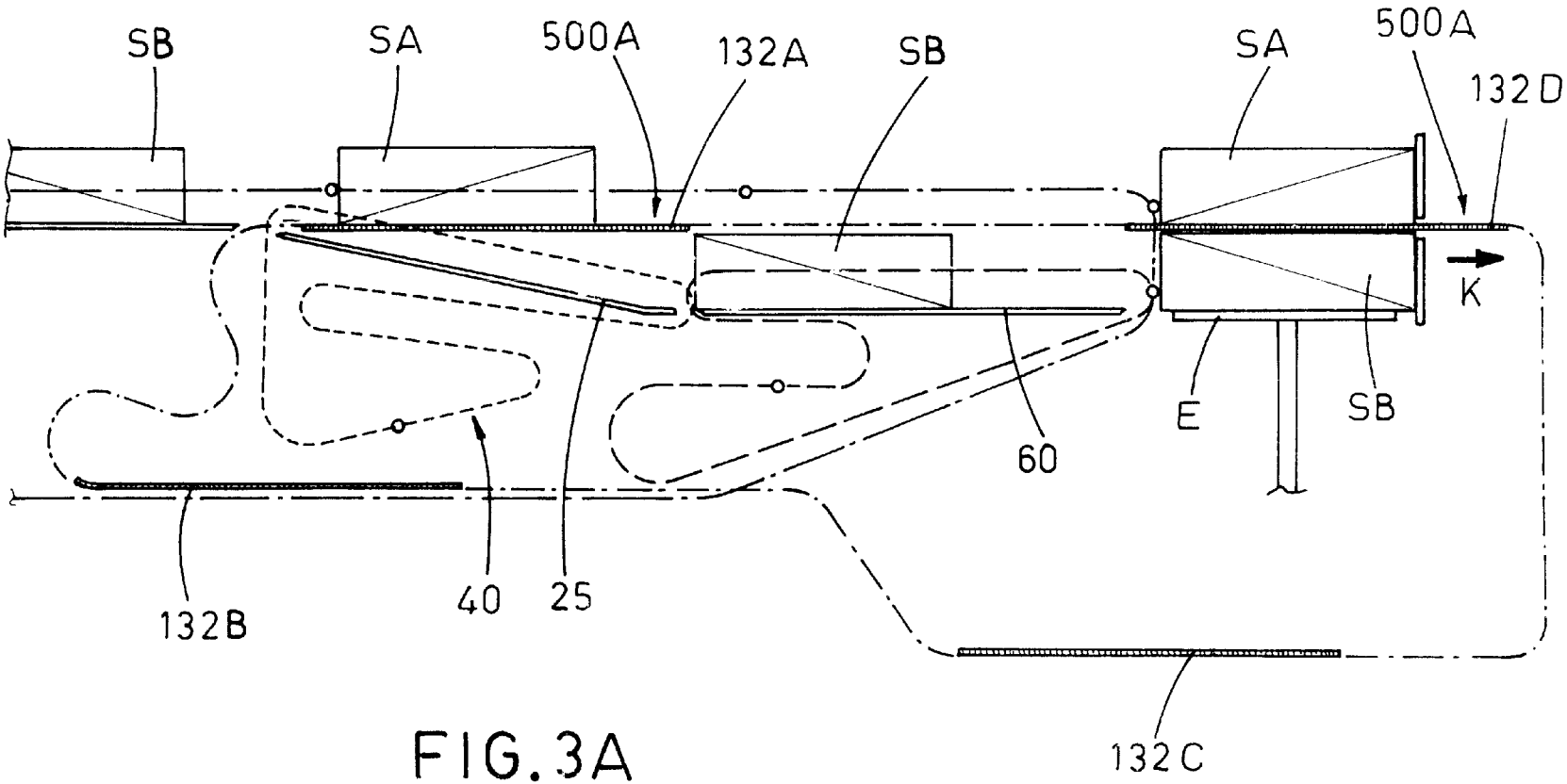
FIGS. 3A, 3B show technical-functional aspects of a second embodiment of the proposed station.

FIG. 3A shows one odd layer SA situated in the region of the window 20 and lying against one shutter 132A, the even layer SB, preceding the odd layer SA, is kept motionless in waiting position on the lower surface 60.

Figure 3B:
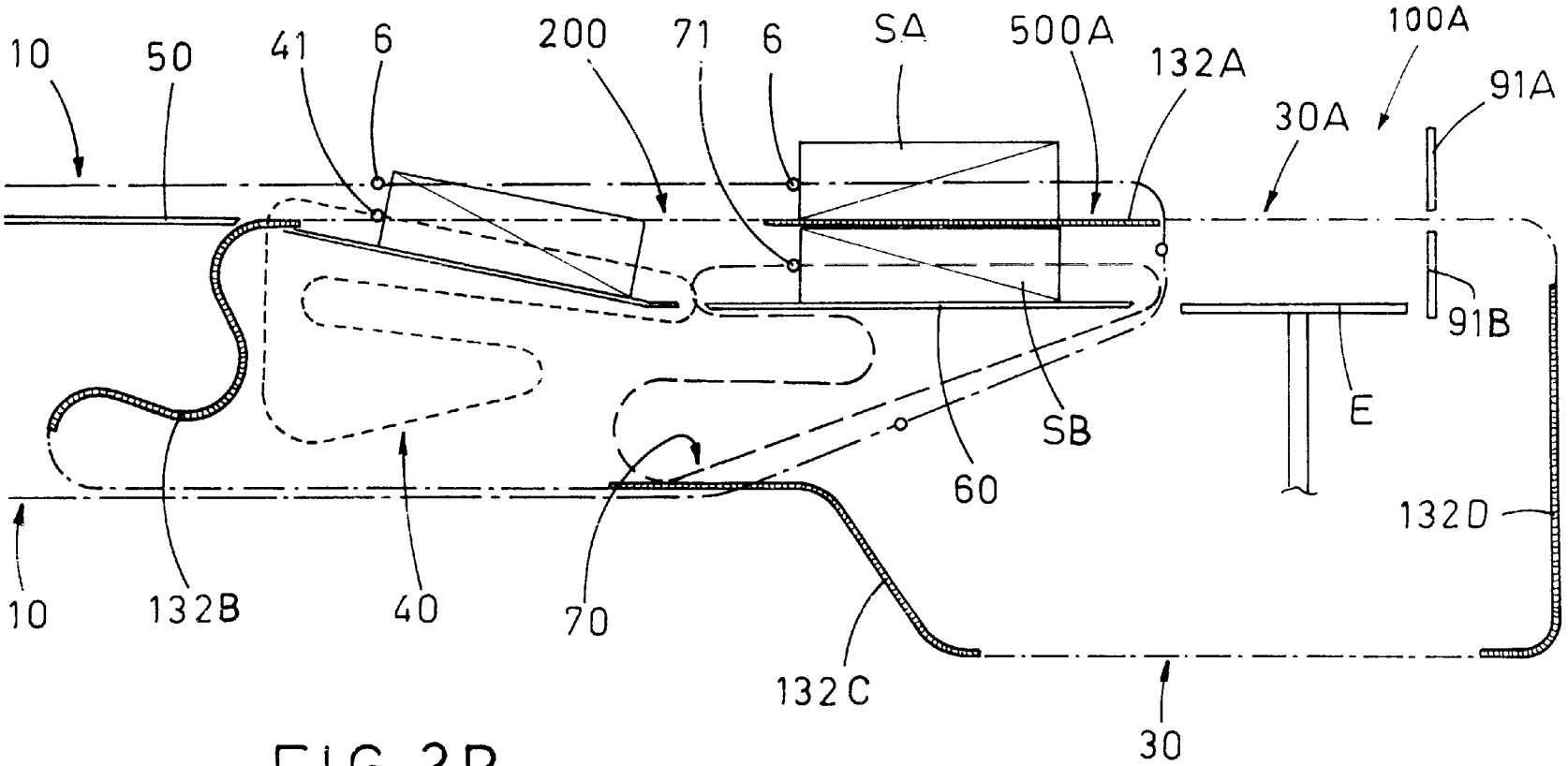

In FIG. 3B, the shutter 132A is situated above the even layer SB pulled on the lower surface 60 by the transversal bar 71 which is aligned vertically with the bar 6 of the first means 10, which in turn strikes against the odd layer SA lying against the shutter 132A (FIG. 3B).

The bars 6 and 71 convey the layers SA, SB to the final part 100A, from which they disengage at the same time (FIG. 3B).

The shutter 132A, translating in the direction K, disengages from the layers SA, SB, which cannot slide horizontally, because they are stopped by the vertical stops 91A, 91B.

The distance between the two subsequent shutters 132A, 132B allows to direct each of the even layers SB onto the stationary descending ramp 25 through the "dynamic" window 200 defined by the rear part of the shutter 132A and the front part of the stationary descending ramp 25.

Consequently, the layers SA, SB are conveyed on the upper surface 50A, 500A and the lower surface 60, respectively, by the moving bars 6 and 71, which are aligned on a vertical plane and are operated synchronously.

At the end of the upper surface, the odd layer SA is arranged over the even layer SB, situated below, without any reciprocal rubbing.

The support surface 50 is connected with the upper surface 50A and with the lower surface 60 without any moving parts, oscillating alternately, but by a moving platform 32, which bridges cyclically with the upper surface 50A, and with the stationary descending ramp 25.

This allows to simplify, with respect to the prior art, the conformation of the station for forming stacks of articles layers, and to increase the production rate.

The proposed station allows obtaining a stack of only one layer S, defined by a number of rolls lower or equal to the number of channels C.

In order to obtain a stack of one layer, it is enough that control means (FIGS. 1A, 1B, 2) maintain the shutter 32 fixed in the region of the window 20, to deactivate the second and third moving means 40, 70, so that the bars 41 and 71 do not obstacle the operation of the station 100.

In this situation, all the odd layers SA and even layers SB move forward orderly, in a horizontal direction, on the upper surface 50A, which extends (see the portion 50B indicated with broken line in FIG. 1A), up to the elevator E, situated at the same level as the upper surface.

The articles to be stacked can be different from rolls of paper.

What is claimed is:

1. A station for forming stacks of layers of articles, situated downstream of a station for feeding the layers, said forming station including:

a horizontal supporting surface;

a first surface, situated after said horizontal support surface and distanced therefrom, so as to define a window, with the dimension of said window allowing one layer of said articles layers to pass freely therethrough;

first moving means for moving the layers along said support surface and first surface;

a stationary descending ramp, which begins from the initial part of said window and extends downwards;

a second horizontal surface, situated after the downstream end of said ramp and below said first working plane;

an additional conveyor associated to at least said window and aimed at moving, cooperating with said first moving means, odd layers from said support surface to said first surface while allowing even layers coming from said support surface to pass through the window, thus directing the even layers, due to gravity, onto said stationary descending ramp;

second moving means for moving each even layer to said ramp and conveying said even layer to said second surface; third means for moving each even layer onto said second surface, situated below, with said even layer moving with the same speed as the corresponding odd layer, conveyed thereover by said first moving means on said first working plane.

2. Station, according to claim 1, wherein the speed of said additional conveyor is equal to said first moving means.

3. Station, according to claim 1, wherein said additional conveyor includes two endless chains extending along relative vertical planes, situated on both longitudinal sides of the window, to which battens, disposed side by side, are connected, so as to define a flexible shutter, whose longitudinal dimension is substantially equal to the longitudinal dimension of said window.

4. Station, according to claim 3, wherein the speed of said additional conveyor is equal to said first moving means.

5. A station, according to claim 1, wherein said first surface is stationary and said additional conveyor is formed by at least one moving platform, assuming a rest position in which it does not cover the window, and a working position in which it covers said window gradually toward a downstream side of said window and at the same level as said first surface to receive a relative odd layer, on which said first moving means act.

6. Station, according to claim 5, wherein the speed of said additional conveyor is equal to said first moving means.

7. Station, according to claim 5, wherein said additional conveyor includes two endless chains extending along relative vertical planes, situated on both longitudinal sides of the window, to which battens, disposed side by side, are connected, so as to define a flexible shutter, whose longitudinal dimension is substantially equal to the longitudinal dimension of said window.

8. Station, according to claim 7, wherein the speed of said additional conveyor is equal to said first moving means.

9. Station, according to claim 7, wherein said first surface is coplanar with said horizontal support surface.

10. Station, according to claim 1, wherein said first surface moves horizontally, with the speed equal to the speed of said first moving means and is defined by at least one moving platform, said moving platform forming said additional conveyor and being moved so as to go in alignment gradually with and after said horizontal support surface, to receive a relative one odd layer, being moved horizontally downstream to be situated above said second surface, and finally being removed from beneath said layers in a final part of said station, where the layers are stopped and arranged one over another.

11. Station, according to claim 10, wherein the speed of said additional conveyor is equal to said first moving means.

12. Station, according to claim 10, wherein said first surface is coplanar with said horizontal support surface.

13. Station, according to claim 10, wherein said moving platform includes a plurality of battens disposed side by side, which define a flexible shutter, whose ends are fastened to two endless chains extending along relative vertical planes, situated beside both longitudinal sides of the window.

14. Station, according to claim 13, wherein the speed of said additional conveyor is equal to said first moving means.

15. Station, according to claim 1, wherein said first moving means include spaced out pushers formed by first transversal bars, whose ends are fastened to two endless chains extending along relative vertical planes, arranged on both longitudinal sides of said support surface and first surface, and said third moving means include spaced out pushers formed by third transversal bars, whose ends are fastened to two endless chains extending along relative vertical planes, situated on both longitudinal sides of said second surface.

16. Station, according to claim 5, wherein it includes control means for activating and deactivating said second and third moving operating means, to deactivate said additional conveyor, so as to restore and stabilize the continuity between said support surface and said first surface, which consequently sends said odd layers and even layers toward the first surface.

* * * * *